United States Patent [19]

Samuelson

[11] Patent Number: 4,895,198

[45] Date of Patent: Jan. 23, 1990

[54] MONEY ORGANIZER AND CARRIER

[76] Inventor: Sydney W. Samuelson, 31 West Heath Avenue, Golders Green, London, United Kingdom, NW11 7QJ

[21] Appl. No.: 228,918

[22] PCT Filed: Nov. 18, 1988

[86] PCT No.: PCT/GB87/00820

§ 371 Date: Aug. 1, 1988

§ 102(e) Date: Aug. 1, 1988

[87] PCT Pub. No.: WO88/04147

PCT Pub. Date: Jun. 16, 1988

[30] Foreign Application Priority Data

Dec. 11, 1986 [GB] United Kingdom ..... 8629629

[51] Int. Cl.[4] ..... A45C 1/00

[52] U.S. Cl. ..... 150/138; 150/111; 150/113; 383/23; 383/37; 383/39

[58] Field of Search ..... 150/131, 138, 113, 111, 150/117; 383/40, 38, 39, 23

[56] References Cited

U.S. PATENT DOCUMENTS

| | | | |
|---|---|---|---|
| 2,129,857 | 9/1938 | Metzger | 383/39 X |
| 2,275,363 | 3/1942 | Guhne | 150/131 |
| 2,467,662 | 4/1949 | Freiberg | 150/117 |
| 2,707,010 | 4/1955 | Armistead | 323/40 X |
| 2,803,281 | 8/1957 | Sutton | 150/138 |
| 3,139,133 | 6/1964 | Spector | 383/40 X |
| 3,818,963 | 6/1974 | Whitman | 383/40 |
| 3,929,224 | 12/1975 | Smith, Jr. | 383/23 X |
| 4,177,909 | 12/1979 | Haskell | 150/111 X |
| 4,401,219 | 8/1983 | Mink | 206/566 |
| 4,580,667 | 4/1986 | Herwood | 150/113 X |

FOREIGN PATENT DOCUMENTS

| | | | |
|---|---|---|---|
| 1632546 | 9/1969 | Fed. Rep. of Germany . | |
| 1309092 | 10/1962 | France . | |
| 854783 | 11/1960 | United Kingdom | 383/38 |

*Primary Examiner*—Sue A. Weaver

*Attorney, Agent, or Firm*—Lee, Mann, Smith, McWilliams & Sweeney

[57] ABSTRACT

A money organizer comprises a carrier sheet (40) adapted for suspension from a clothes-type hanger (60) or the like, and a plurality of labelled pouches (10) intended for carrying differing currencies, each said pouch (10) being adapted for attachment to the carrier sheet (40).

10 Claims, 6 Drawing Sheets

MONEY ORGANIZER AND CARRIER

DESCRIPTION

1. Field of the Invention

This invention relates to money pouches, more especially a plurality of such pouches intended to hold different types of currency, and to a carrier for such a plurality of pouches, which combination of carrier and pouches is herein referred to as a money organiser.

2. Background to the Invention

Travellers through foreign countries frequently experience difficulty in monitoring segregation of different currencies, especially coinage, and of selecting a currency to be used on a particular day or occasion. Moreover coinage, often needed on first arrival in one country, is often not available from a bank in a preceding country, so that it is often advantageous to carry at least small amounts of all possible currencies which may be wanted, and to store such currencies when not travelling.

It is an object of the present invention to provide a solution to these problems.

THE INVENTION

According to one aspect of the invention, there is provided a money organiser which comprises a plurality of pouches for holding currencies of differeing types, currency-type labels for attachment to the respective pouches, and a carrier for said pouches which comprises a flexible sheet capable of attachment to a supporting member to depend therefrom, said carrier sheet and pouches having mutually cooperable means by which the pouches can be attached to the carrier with the currency labels visible.

Preferably, the pouches are of a flat shape, with a windowed pocket on one face for receiving a label. In one embodiment, a rigid tag is provided on the other face of the pouch and for insertion into a carrier sheet slot to attach the pouch to said carrier. The pouch is thus attached to the outside of the carrier sheet, with the currency label on its outer face. In another embodiment, slots are provided in the pouch adjacent the periphery thereof for receiving tabs, conveniently twist tabs, provided on the carrier sheet.

In the first-mentioned embodiment, the tag is preferably integrally formed with an upper edging strip for the pouch, said strip being foldable generally about its longitudinal centre line so that two parts on opposite sides of said line can be secured together, as by means of press studs or rivets, with the upper edge of the pouch material gripped between them. In the second embodiment, the carrier sheet is preferably provied with spaced reinforcement strips which carry the twistable or other tabs.

The pouch material is preferably a flexible plastics material such as pvc, and at least the material forming the outer face may be transparent or translucent. The upper edging strip with integral tag or pouch attachment slots may be formed of a rigid plastics material such as polypropylene. A longitudinal opening, closable and reopenable by a slider, may be provided in the pouch material on the outer face thereof, for example above or to the side of the label-receiving pocket.

According to another aspect of the invention, therefore, there is provided a money pouch which is generally of a flat shape with a windowed pocket on one face, the pouch comprising a bag of flexible transparent material openable and closable by a sliding fastener, the bag depending from an upper edging strip which is formed with a means for enabling attachment of the pouch to a carrier. In one embodiment, the edging strip of the pouch is integrally formed with attachment means comprising a rigid tag depending from the edging strip over the face of the pouch remote from the windowed pocket. In another embodiment, the attachment means is constituted by slots in the edging strip.

A preferred tag in the first embodiment is of a sideways E-shape, having the "free" ends of its limbs integral with the edging strip, thereby to form a buckle by which the money pouch can be attached to and worn on a belt.

According to another aspect of the invention, there is provided a carrier for money pouches, which carrier comprises a flexible sheet having releasable means enabling its suspension from a supporting member either with one end of said sheet attached to said supporting member or with the general centre line of the folded sheet attached thereto, the sheet having means for the attachment of a plurality of money pouches each in an upright orientation, regardless of whether the carrier sheet is suspended in open or folded condition.

The carrier sheet may be adapted for attachment to a suporting hook or rail such as, for example, the hanger bar of a clothes-type hanger. For enabling ready suspension of the carrier, the latter may have an arched suspension element which is pivotally mounted for movement between closed and open positions, and preferably being lockable with a securing means in its closed position. Alternatively or additionally, however, as the pouches may have a fairly substantial combined weight it is preferred to provide the carrier with a releasable strap means, which at least partly transfers weight directly from the carrier to the hanger hook, thus relieving the hanger bar of at least part of the load. The strap means is most desirably usable whether the carrier is suspended open or folded, being securable to and releasable from alternative strap-receiving openings provided in the carrier sheet, respectively near its centre and at least at one end.

DESCRIPTION OF DRAWINGS

The invention is exemplified with reference to the accompanying drawings, in which.

DESCRIPTION OF EMBODIMENT

Figure 1:
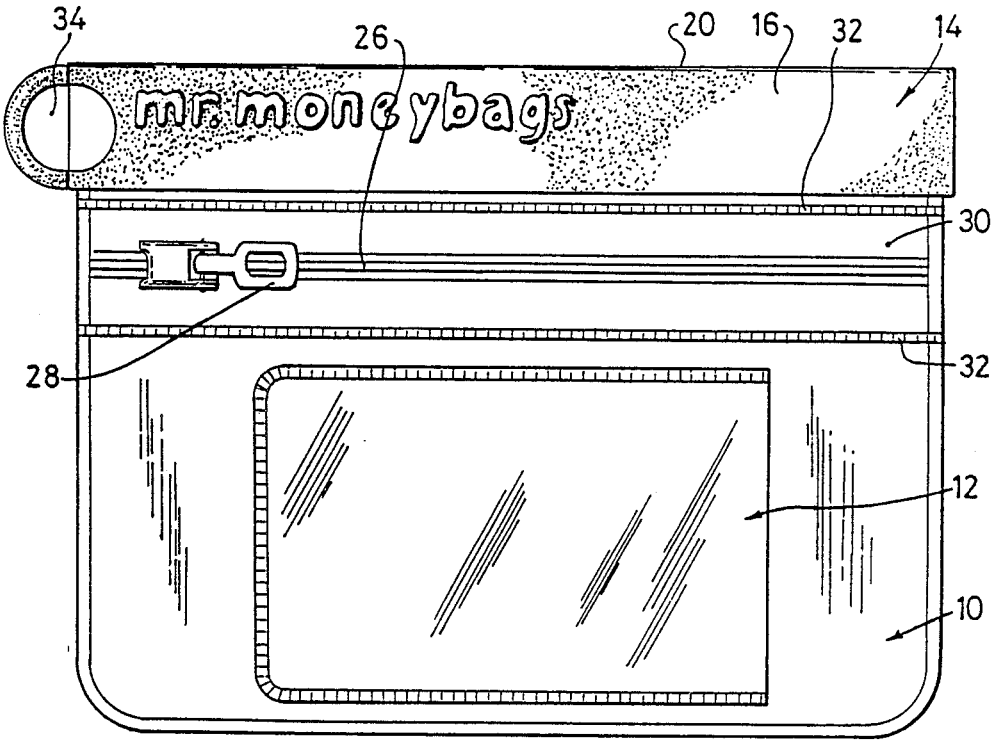
FIG. 1, is a front elevation view of a money pouch.
Figure 2:
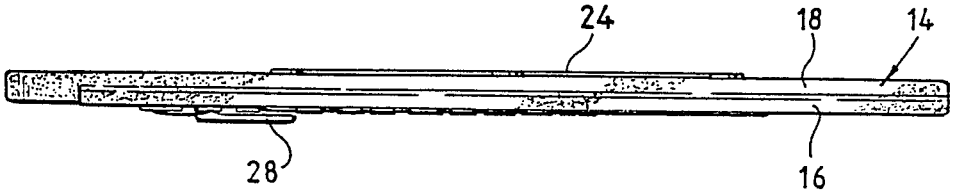
FIG. 2 is a top edge view of the pouch.
Figure 3:
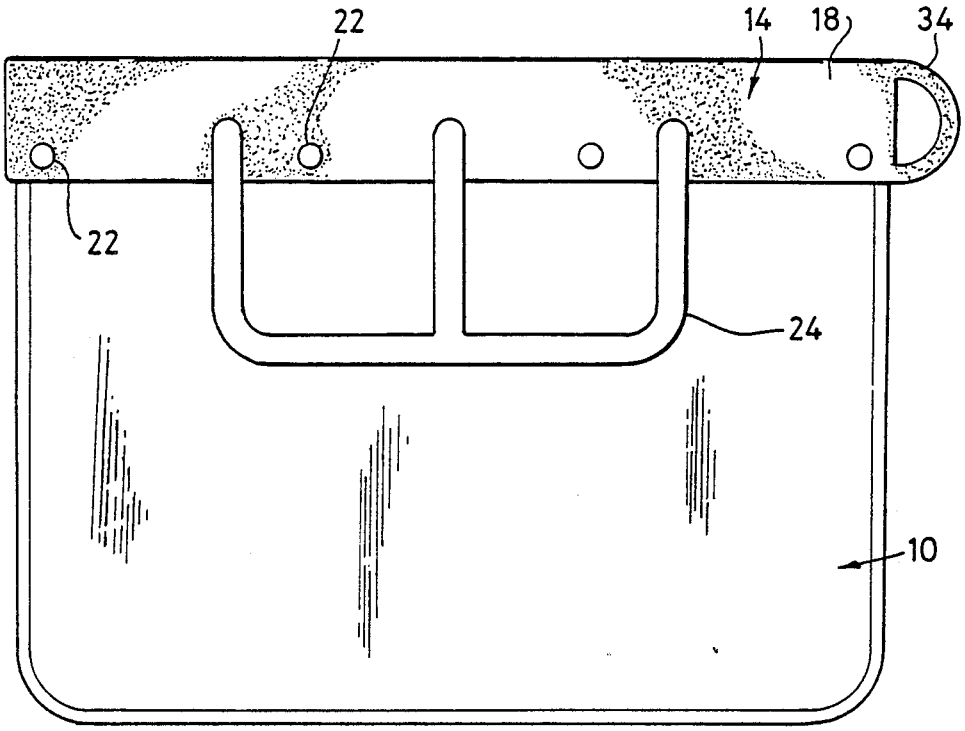
FIG. 3 is a rear elevational view of the pouch.

FIGS. 1 to 3 show a pouch which comprises one of a plurality intended for carrying currencies of different types, including coinage. The pouch comprises a bag 10 of transparent plastics material, generally of a flat rectangular shape with an additional transparent piece welded on one face and defining a windowed pocket 12. The bag 10 depends from an upper edging strap 14 of substantially rigid plastics material which comprises two parts 16, 18 on opposite sides of a centre-line fold 20. The two parts 16, 18 secure together, as by means of studs indicated at 22, to grip the upper edge of the bag 10 between them. The rear part 18 of the upper edging strip is integrally formed with a tag 24, generally of a sideways E-shape, which depends from the edging strip over the rear face of the bag remote from the windowed pocket on the front face. The bag 10 is equipped with a longitudinal opening 26, closable and re-openable by a slide fastener 28, conveniently formed as part of an additional plastics piece 30, not necessarily transparent, integrated with the main portion of the bag by rib welds 32.

The edging strip 14 is also formed with a thumb-and-finger grip 34, which could be alternatively shaped so as to enable fastening on to a trouser belt or the like. In the embodiment illustrated, the E-shaped tag 24 forms a buckle by which the bag can be attached to and worn on a belt.

Figure 4:
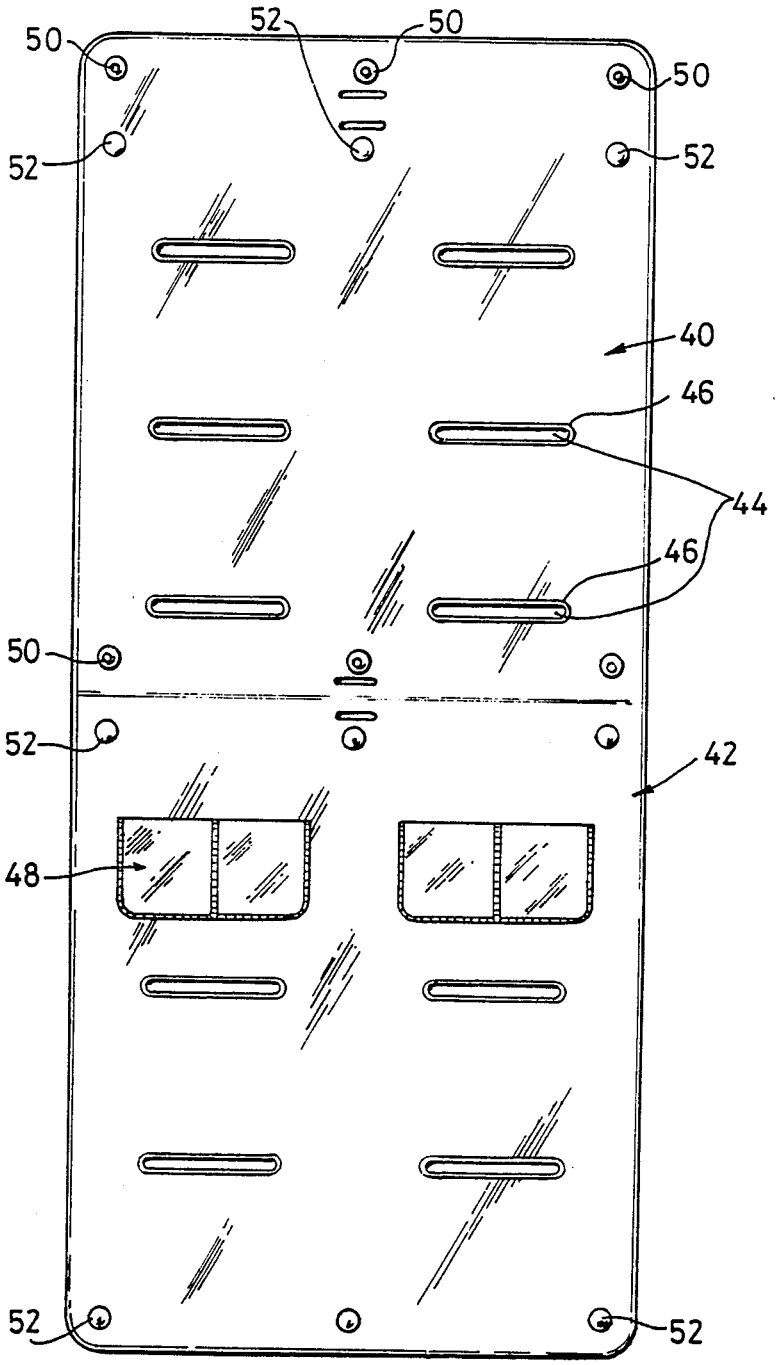
FIG. 4 is a front view of a carrier sheet.
Figure 5:
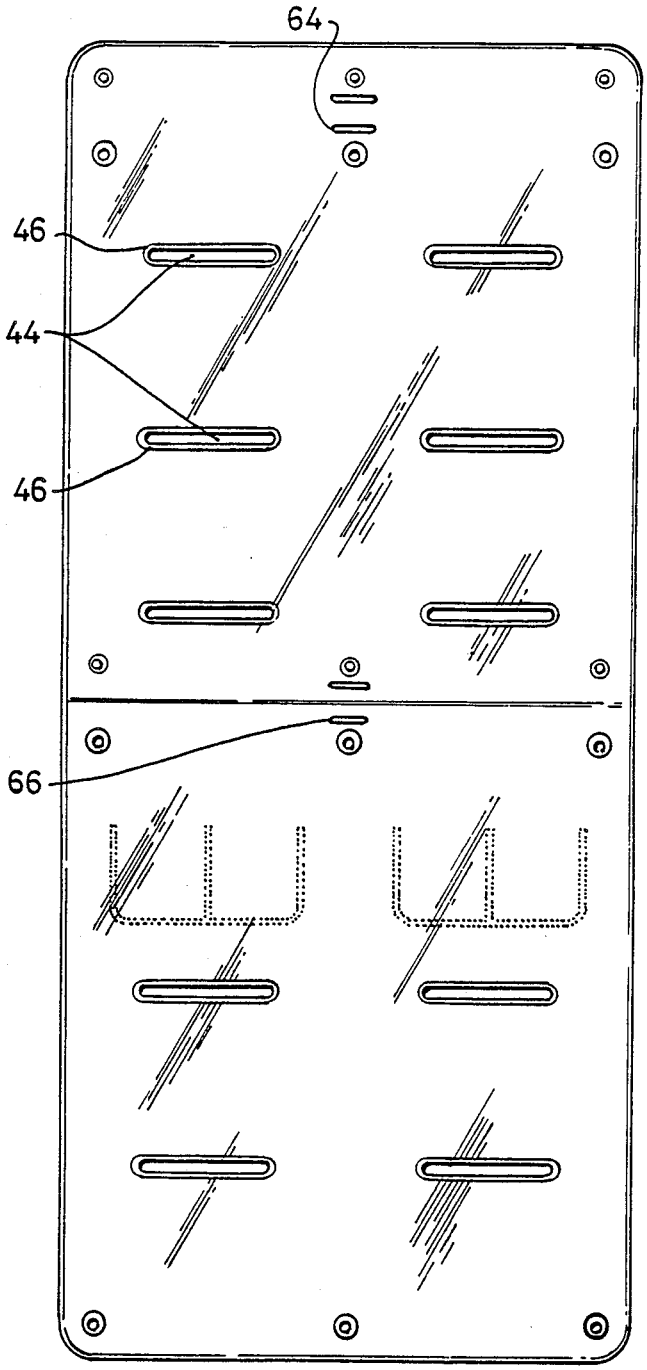
FIG. 5 is a rear view of the carrier sheet.

FIGS. 4 and 5, show a carrier for a plurality of the aforedescribed pouches of FIGS. 1 to 3. This carrier comprises a sheet 40 of plastics material, which is preferably non-transparent, comprising front and rear layers which are edge welded, as indicated at 42.

Slots 44, extending through both layers of the sheet, are stiffened by peripheral welds 46. These slots are dimensioned to receive the tags 24 of the previously described money pouches. An attached pouch will then be suspended on the front face of the carrier, with its windowed pocket, containing a currency label appropriate to the currency in the pouch, exposed to view.

The carrier 40 is also formed with welded-on pockets 48, for receiving currency label cards, which are selected for insertion in the windowed pocket of a money pouch as necessary. Spare label cards remain in the pockets 48.

Moreover the carrier 40 has press studs, male studs 50 and female studs 52, which enable the carrier to be used open or in a condition which it is folded about its centre line.

Figure 6:
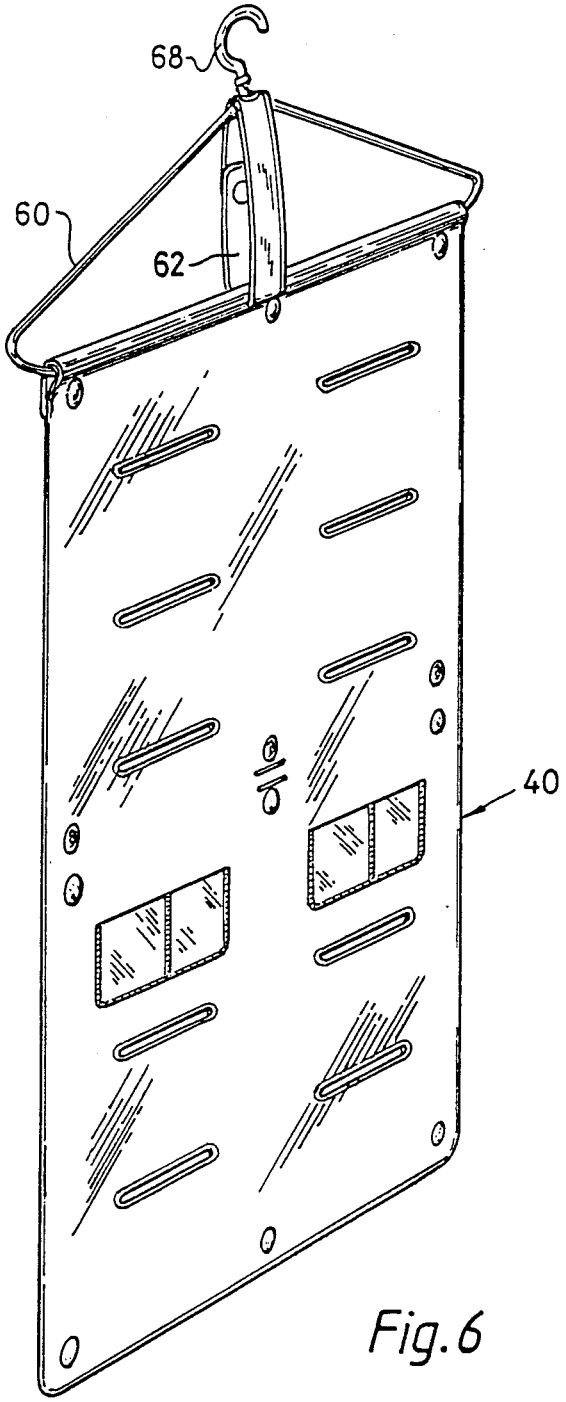
FIG. 6 is a perspective view of the carrier sheet when suspended in open condition from a hanger.
Figure 7:
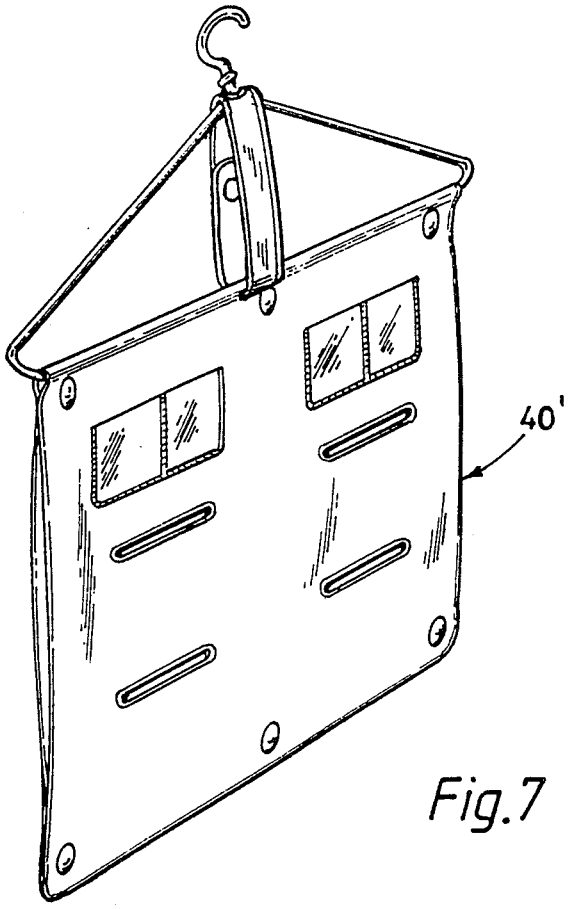
FIG. 7 is a view similar to that of FIG. 6 but with the carrier sheet folded.

Referring to FIG. 6, the open carrier 40 is shown suspended from a clothes-type hanger 60. Studs 50 and 52 are used to secure one end of the carrier sheet around the hanger bar. FIG. 7 shows the folded carrier 40 hung over the hanger bar, enabled by the use of different press studs 50 and 52.

Money pouches as described with reference to FIGS. 1 to 3 are attached upright to the carrier, i.e. the tags are pushed down through the carrier slots, regardless of whether the carrier is used open or folded. Most preferably, however, the positioning of the tag-receiving slots is such that the money pouches are at least not wholly aligned, front and back, when supported on a folded carrier.

In both FIGS. 6 and 7, there is shown a releasable strap 62, which passes through slots 64 or 66 in carrier sheet 40, and itself engages over the hook 68 of the hanger 60. By means of this strap, the weight of the carrier, when loaded with money bags, is at least transferred directly to the hook, in part releasing strain on the relatively weak hanger bar.

It will be appreciated that the above described embodiment is by way of example only, and may be modified in various ways within the scope of the invention hereinbefore defined. Thus, in a second embodiment (not illustrated) the carrier sheet is provided with reinforcement strips at which twist tabs are secured to said sheet, and the pouches, in place of the afore-described tags, are formed with slots in the upper edging strip for cooperation with the twist tabs.

I claim:

1. A money organiser which comprises a flat, flexible and foldable carrier sheet having means enabling attachment of the sheet to a hooked supporting member generally in the form of a coat hanger in order to depend therefrom, said sheet being provided with a label holding pocket, currency-type labels which can be stored in the holding pocket of the carrier sheet, pouches of flexible plastics material for holding currencies of different types, said pouches each having on one face a window pocket with a transparent window for receiving a label transferred from the holding pocket, and said carrier sheet and the faces of the pouches opposite to said windowed pockets being provided with mutually cooperating means for attaching said pouches to said carrier sheet with the currency-type labels visible simultaneously in each said window when attached to said carrier sheet, each pouch having an upper edging strip of rigid plastics material provided with attachment means comprising a part of said mutually cooperating means by which the pouch attaches to the carrier sheet.

2. A money organiser according to claim 1, wherein the pouches are each of a flat shape.

3. A money organiser according to claim 2, in which said mutually cooperating means comprises a rigid tag on the opposite face of the pouch and for insertion into a carrier sheet slot to attach the pouch to said carrier.

4. A money organiser according to claim 1, wherein said money pouches are generally of a flat shape, each pouch comprising a bag of flexible transparent material openable and closable by a sliding fastener, the bag depending from said upper edging strip which is formed with said attachment means comprising a part of said mutually cooperating means for enabling attachment of the pouch to the carrier sheet.

5. A money organiser according to claim 1, in which said carrier sheet includes releasable means enabling its suspension from a supporting member either with one end of said sheet attached to said supporting member or with the general centre line of the folded sheet attached thereto, the sheet having means comprising a part of said mutually cooperating means for the attachment of a plurality of money pouches each in an upright orientation, regardless of whether the carrier sheet is suspended in open or folded condition.

6. A money organiser according to claim 5 wherein, for enabling ready suspension of the carrier sheet, the latter has an arched suspension element which is pivotally mounted for movement between closed and open positions, and preferably being lockable with a securing means in its closed position.

7. A money organiser according to claim 5, adapted for suspension from a clothes-type hanger having a hook and a bar, wherein the carrier sheet has a releasable strap means, which at least partly transfers weight directly from the carrier sheet to the hanger hook, thus relieving the hanger bar of at least part of the load.

8. A money organiser according to claim 7, wherein the strap means is usable whether the carrier sheet is suspended open or folded, being securable to and releasable from alternative strap-receiving openings provided in the carrier sheet, respectively near its centre and at least at one end.

9. A money organiser according to claim 2, wherein the pouches include at least the one face being of transparent or translucent plastics material.

10. A money organiser according to claim 3, wherein the pouches include at least the one face being of transparent or translucent plastics material.

* * * * *